US008342509B2

(12) United States Patent
Takiguchi et al.

(10) Patent No.: US 8,342,509 B2
(45) Date of Patent: Jan. 1, 2013

(54) SHEET FEEDING APPARATUS AND IMAGE FORMING APPARATUS

(75) Inventors: Masatoshi Takiguchi, Susono (JP); Shinya Noda, Mishima (JP); Shinji Kubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/155,798

(22) Filed: Jun. 8, 2011

(65) Prior Publication Data

US 2011/0316223 A1 Dec. 29, 2011

(30) Foreign Application Priority Data

Jun. 28, 2010 (JP) ..... 2010-146195
Nov. 19, 2010 (JP) ..... 2010-259020

(51) Int. Cl.
*B65H 3/06* (2006.01)

(52) U.S. Cl. ..... 271/119; 271/126; 271/127

(58) Field of Classification Search ..... 271/119, 271/126, 127, 160, 162, 109
See application file for complete search history.

(56) References Cited

U.S. PATENT DOCUMENTS

| | | | | |
|---|---|---|---|---|
| 3,992,557 | A | 11/1976 | Kubo et al. | |
| 5,253,854 | A | 10/1993 | Tanoue et al. | |
| 6,070,867 | A * | 6/2000 | Tsurumi et al. | 271/114 |
| 7,594,650 | B2 * | 9/2009 | Chung et al. | 271/116 |
| 2011/0156336 | A1 | 6/2011 | Agata et al. | |

* cited by examiner

*Primary Examiner* — Prasad Gokhale
(74) *Attorney, Agent, or Firm* — Fitzpatrick, Cella, Harper & Scinto

(57) ABSTRACT

At a start of sheet feeding operation, a feed cam starts to rotate in association with rotation of a feed shaft and a feed roller starts to rotate from a time when the feed shaft has passed an idle zone, so as to send out each of sheets on a rising and lowering plate. After that, the feed roller is returned to a feed initial position by a return mechanism including a conveyance roller and a feed rotatable member. A cam curve of the feed cam reduces a rising speed as compared to a rising speed of a conventional rising and lowering plate, and reduces generation of noise at the time of collision between the sheets on the rising and lowering plate and the feed rotatable member. Thus, an image forming apparatus having lower noise level can be provided.

12 Claims, 15 Drawing Sheets

SHEET FEEDING APPARATUS AND IMAGE FORMING APPARATUS

BACKGROUND OF THE INVENTION

1. Field of the Invention

The present invention relates to a sheet feeding apparatus provided in an image forming apparatus such as a copying machine or a laser beam printer for forming an image on a sheet, and relates to an image forming apparatus including the sheet feeding apparatus.

2. Description of the Related Art

Conventionally, in a sheet feeding apparatus provided in an image forming apparatus, in general, an uppermost sheet of sheets stacked on a rising and lowering plate is sequentially fed to an image forming portion by a feed roller. In such a sheet feeding apparatus, the rising and lowering plate, which is provided so as to be swingable, is urged by a coil spring in a direction of the feed roller to bring an uppermost surface of a stack of the sheets stacked on the rising and lowering plate into press-contact with the feed roller.

Further, U.S. Pat. No. 5,253,854 proposes the following sheet feeding apparatus. Specifically, the sheet feeding apparatus includes the feed cams fixed coaxially with the feed roller. While the feed roller rotates to send out a sheet, the feed cams push down the rising and lowering plate to a certain position against an urging force of the coil spring.

As described above, in the sheet feeding apparatus including the mechanism for pushing down the rising and lowering plate by the feed cams, at the time of waiting, the rising and lowering plate can be kept pushed down at the certain position. Thus, setting and replacement of the sheets are facilitated, and by pushing down the rising and lowering plate while sending out the sheet, a separating property of the sheet is improved at the separating portion such as the separating pad.

With reference to FIG. 17, operations of the sheet feeding apparatus performed in the image forming apparatus from sheet feeding to sheet delivery after image formation will be briefly described.

As illustrated in FIG. 17, sheets S set on a feed tray 1 are each sent out in such a manner that a feed roller 2 is rotated through transmission of drive of a drive motor 16, and one of the sheets is separated by a separating pad. The fed sheet S is conveyed via conveyance rollers 3*a* and 3*b* to a transfer nip as an image transferring portion formed by a photosensitive drum 8 and a transfer roller 9. A rising and lowering plate 22 provided in the feed tray 1 can rise and lower, and is urged upward by a feed spring 23. Cams 21 are provided coaxially with the feed roller 2, and are held in slide-contact with cam followers 22*b* provided on the rising and lowering plate 22. Further, when the feed roller 2 rotates, the cams 21 rotate to raise and lower the rising and lowering plate 22 through the cam followers 22*b*, and the rising and lowering plate 22 rises to bring the sheet S into press-contact with the feed roller 2, to thereby send out the sheet S.

On the other hand, an image writing laser scanner 5 forms an electrostatic latent image on the photosensitive drum 8 in a process cartridge 7 to prepare a toner image. Onto the sheet S, the toner image formed on the photosensitive drum 8 is transferred as an unfixed image at the transfer nip formed by the photosensitive drum 8 and the transfer roller 9. In order to heat and fix the unfixed image, the sheet S is conveyed to fixing rollers 11, and the unfixed image is heated and fixed onto the sheet S. The sheet S subjected to image fixing is conveyed toward a delivery roller 12 along a conveyance guide 15 so as to be delivered onto a delivery tray 14.

However, in the conventional example described above, in a case of increasing rotation speed of the feed roller 2 for increasing feeding speed of the sheet, or in a case of reducing a diameter of the feed roller 2 for downsizing the sheet feeding apparatus, speed of swing movement of the rising and lowering plate 22 is increased in association with this increase or reduction. As a result, there is a fear in that noise is increased when the sheets abut on the feed roller 2, or a fear in that through repetition of feeding operations, an alignment property of the stacked sheets is deteriorated due to impact caused when the sheets abut on the feed roller 2. In a case where the alignment property of the sheets is deteriorated, there is a fear in that skew occurs at the time of sheet feeding, with the result that image failure, jamming, and the like are likely to occur.

SUMMARY OF THE INVENTION

Therefore, it is an object of the present invention to provide a sheet feeding apparatus which reduces rising speed of a rising and lowering plate by providing an idle zone between a feed roller and a feed cam and has low noise level and high stability of feeding even at the time of high-speed operation, and to provide an image forming apparatus including the sheet feeding apparatus.

According to the present invention, a sheet feeding apparatus includes: a sheet stacking portion which rises and lowers while sheets are stacked on the sheet stacking portion; a feed roller which is attached to a feed shaft and rotates from a feed initial position in association with rotation in one direction of the feed shaft to send out each of the sheets stacked on the sheet stacking portion; an urging member which urges the sheet stacking portion to press the stacked sheets toward the feed roller; a cam member which rotates in association with the rotation of the feed shaft to raise and lower the sheet stacking portion; a predetermined idle zone provided between the feed roller and the feed shaft, for preventing the feed roller from being associated with the rotation of the feed shaft; and a return mechanism which returns the feed roller to the feed initial position after the feed roller finishes feeding of each of the sheets on the sheet stacking portion, wherein at a start of sheet feeding operation, the cam member starts to rotate in association with the rotation of the feed shaft and the feed roller starts to rotate from a time when the feed shaft has passed the predetermined idle zone, so as to send out each of the sheets on the sheet stacking portion, and thereafter the feed roller is returned to the feed initial position by the return mechanism.

Further features of the present invention will become apparent from the following description of exemplary embodiments with reference to the attached drawings.

DESCRIPTION OF THE EMBODIMENTS

First Embodiment

Figure 4:
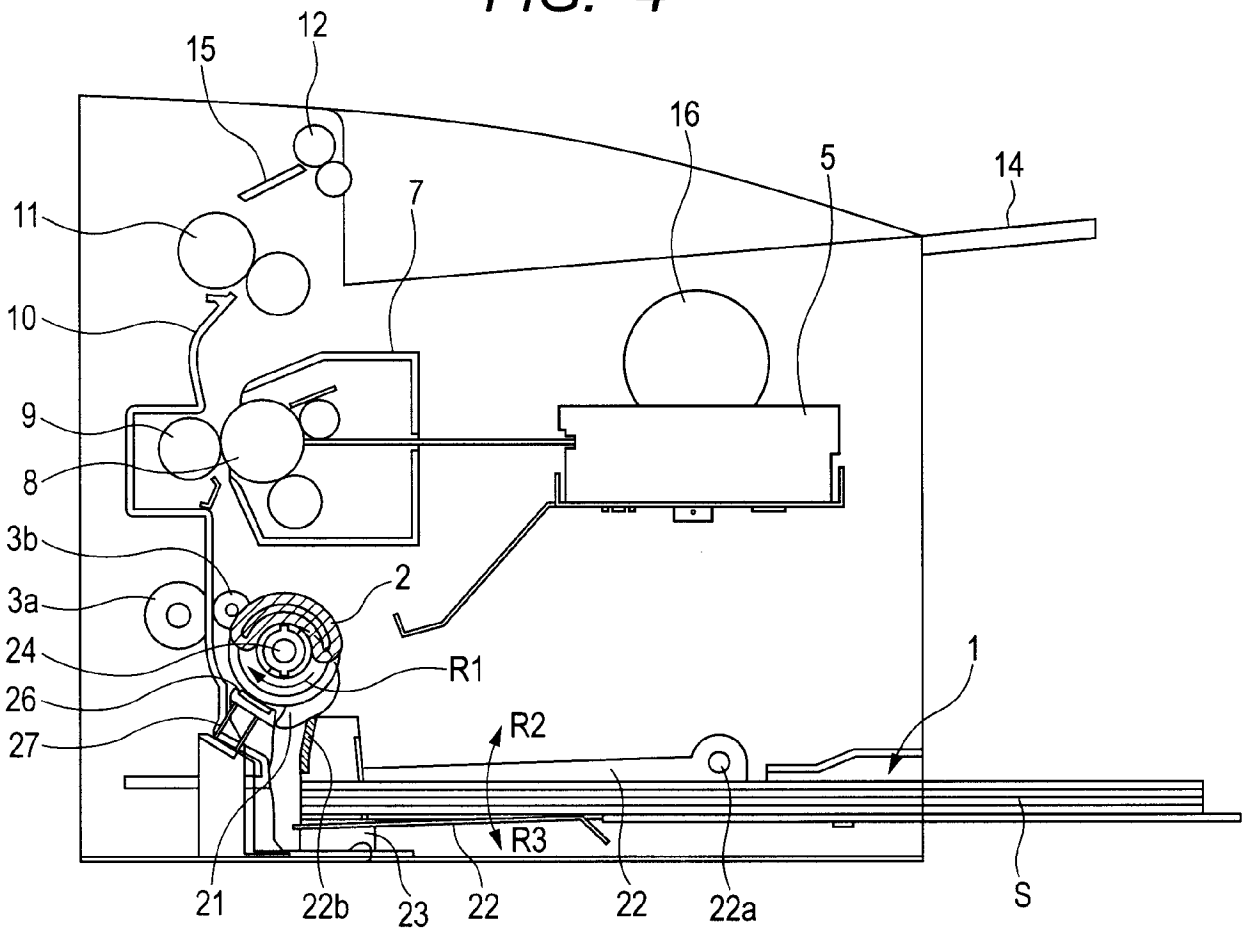
FIG. 4 is a cross-sectional view illustrating a schematic configuration of the image forming apparatus according to the first embodiment.
Figure 17:
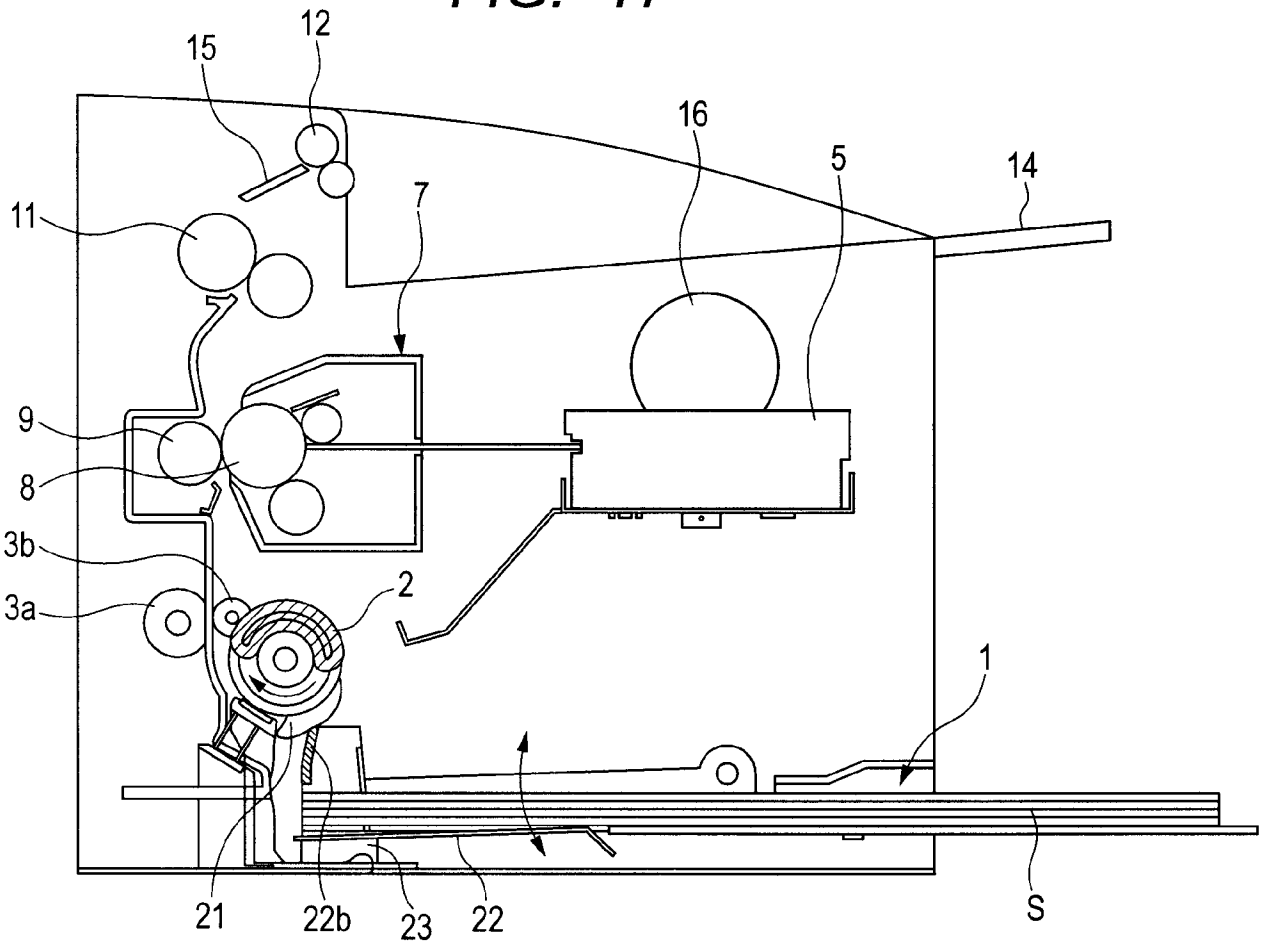
FIG. 17 is a cross-sectional view illustrating a schematic configuration of a conventional image forming apparatus.

In the following, embodiments of the present invention will be described. FIG. 4 is a cross-sectional view illustrating a schematic configuration of an image forming apparatus in which a sheet feeding apparatus according to the present invention is mounted. The configuration, image forming process, and operations from the start of sheet feeding until sheet delivery of the image forming apparatus of this embodiment are substantially the same as those of the conventional example described with reference to FIG. 17. Further, components having the same functions as those of the conventional example of FIG. 17 are denoted by the same reference symbols.

As illustrated in FIG. 4, the sheet feeding apparatus of the image forming apparatus according to the present invention includes a feed tray 1 including a rising and lowering plate 22, a feed roller 2, a feed spring 23, and feed cams 21. The rising and lowering plate 22 constitutes a sheet stacking portion which rises and lowers while sheets S are stacked on the sheet stacking portion. The feed roller 2 rotates from a feed initial position (position illustrated in FIG. 2 and FIG. 6A) in association with rotation in one direction of a feed shaft 24 to send out each of the sheets S stacked on the rising and lowering plate 22 (on the sheet stacking portion). The feed spring 23 constitutes an urging member which presses the sheets S on the rising and lowering plate 22 toward the feed roller 2. The feed cams 21 constitute a cam member which rotates integrally with the feed shaft 24 so as to allow the rising and lowering plate 22 to move according to the force of the feed spring 23 at the time of feeding performed by the feed roller 2, and so as to move the rising and lowering plate 22 away from the feed roller 2 against the force of the feed spring 23 after the feeding performed by the feed roller 2.

Figure 3:
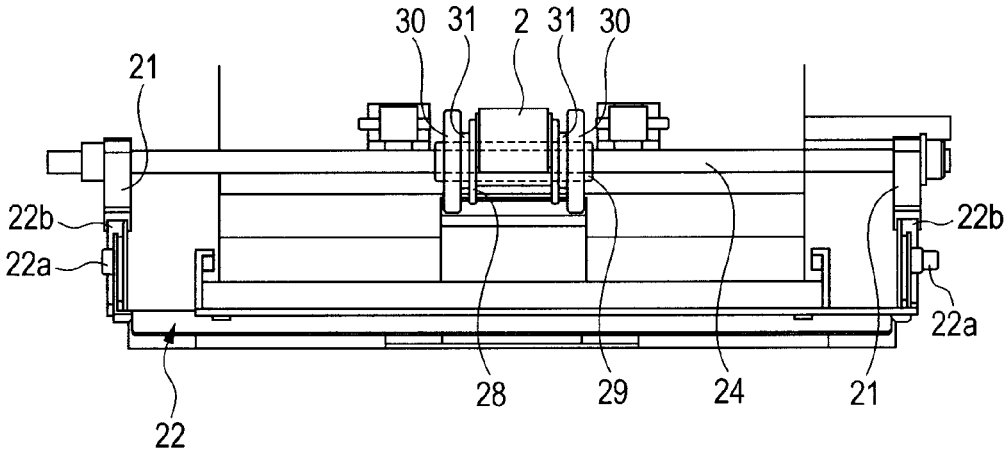
FIG. 3 is a back view illustrating the feed portion of the image forming apparatus according to the first embodiment.

As illustrated in FIG. 3, the feed cams 21 having the same shape are fixed at both end portions of the feed shaft 24, respectively, so as to have the same phase. Each of the feed cams 21 slides on a cam follower (cam contact portion) 22*b* provided at each end portion in a width direction of a front portion of the rising and lowering plate 22, and functions as a push-down portion which pushes down the rising and lowering plate 22 against an urging force of the feed spring 23. The rising and lowering plate 22 is provided on the feed tray 1 so as to make a single reciprocation cycle of swing movement in directions indicated by arrows R2 and R3 in every revolution of the feed cams 21 using rising-and-lowering-plate bosses 22*a* as a pivot fulcrum.

In FIG. 4, by actuation of a drive motor 16, a feed roller solenoid (not shown) in a drive mechanism apparatus is operated to retract, and the sheets S set on the feed tray 1 are brought into a feeding operation. The sheet S is separated and fed by a separating pad 26 in association with rotation of the feed roller 2, and the sheet S sent out from the rising and lowering plate 22 is conveyed to a downstream side by conveyance rollers 3*a* and 3*b*, and then conveyed to a transfer nip as an image transferring portion formed by a photosensitive drum 8 and a transfer roller 9.

An image writing laser scanner 5 forms an electrostatic latent image on the photosensitive drum 8 in a process cartridge 7 to prepare a toner image. Here, onto the sheet S, the toner image formed on the photosensitive drum 8 is transferred as an unfixed image at the transfer nip formed by the photosensitive drum 8 and the transfer roller 9. In order to heat and fix the unfixed image, the sheet S is further sent to fixing rollers 11, and the unfixed image is heated and fixed onto the sheet S. The sheet S subjected to image fixing is conveyed toward a delivery roller 12 along a conveyance guide 15. The delivery roller 12 forms a nip together with a delivery roller that is urged by an elastic force to abut the delivery roller 12, and then delivers the sheet S onto a delivery tray 14. The above-mentioned photosensitive drum 8, transfer roller 9, and the like constitute an image forming portion for forming an image on the sheet S fed by the sheet feeding apparatus. Note that, a separating pad spring is designated by reference numeral 27.

Figure 1:
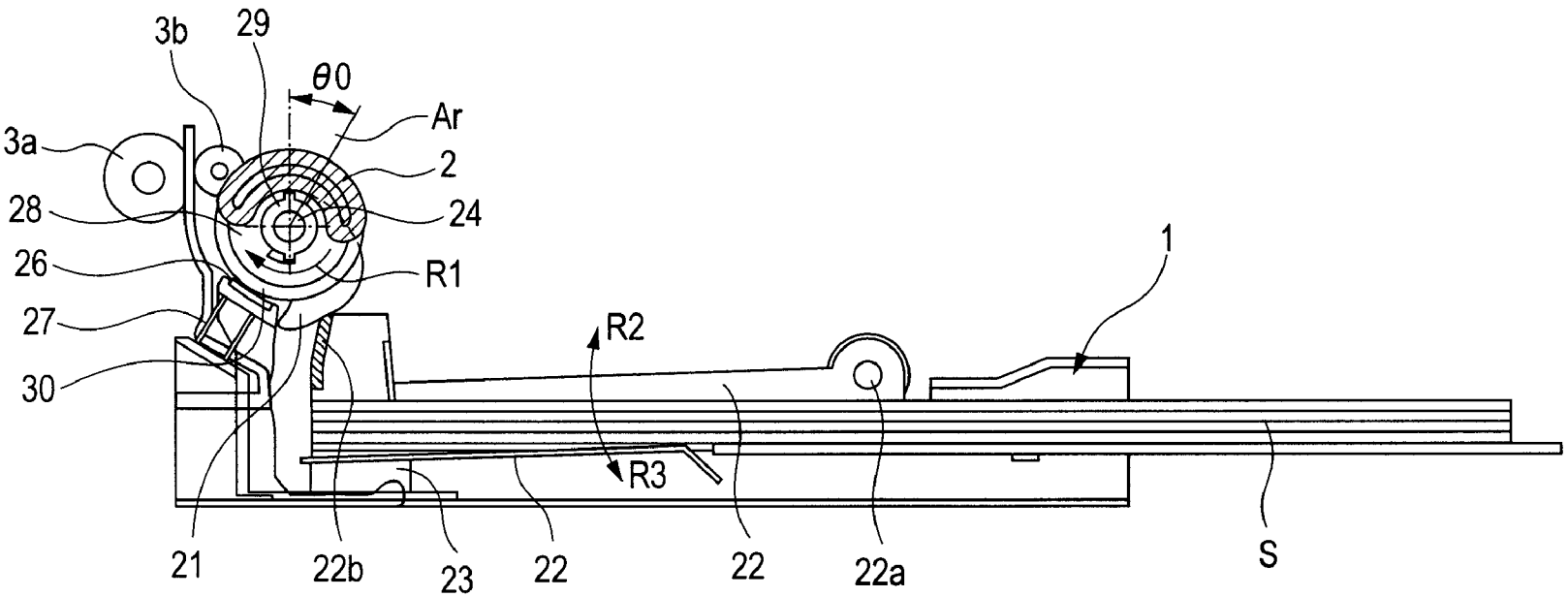
FIG. 1 is a cross-sectional view illustrating a schematic configuration of a feed portion of an image forming apparatus according to a first embodiment of the present invention.
Figure 2:
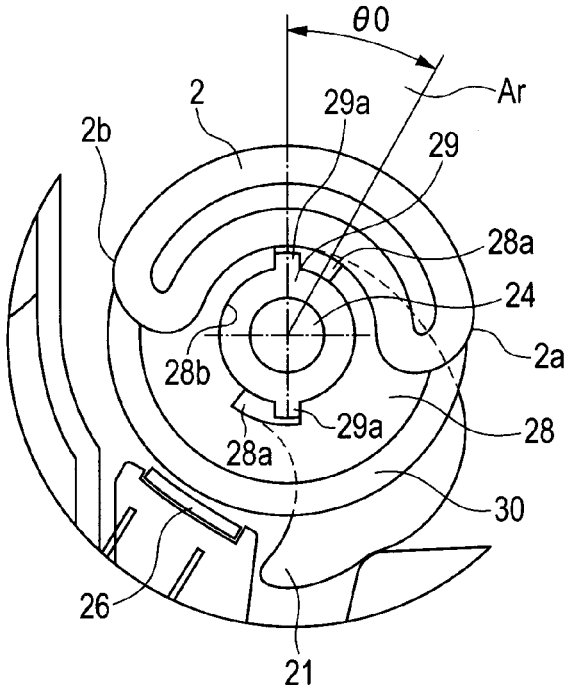
FIG. 2 is a cross-sectional view illustrating a substantial part of the feed portion of the image forming apparatus according to the first embodiment.

With reference to FIG. 1 to FIG. 3, a feed mechanism of the sheet feeding apparatus according to the present invention will be described. FIG. 1 is an enlarged view illustrating the feed mechanism portion of FIG. 4, FIG. 2 is an enlarged view illustrating a vicinity of the feed roller of FIG. 4, and FIG. 3 is an enlarged front view illustrating the feed mechanism of FIG. 4.

As illustrated in FIG. 1, the feed tray 1 is arranged as a sheet containing portion on which the sheets S are stacked in the form of sheaf. The feed spring 23 is provided on a lower surface portion of the rising and lowering plate 22 to impart the urging force to the rising and lowering plate 22 in the direction indicated by the arrow R2 of FIG. 1. The feed shaft 24 is supported by a frame (not shown) so as to be rotatable, and a rotational drive force is transmitted from a drive train (not shown) to the feed shaft 24.

As illustrated in FIG. 1 and FIG. 2, a serration member 29 is fixed onto the feed shaft 24. As illustrated in FIG. 3, the serration member 29 has a length large enough to extend between feed rotatable members 30, and is formed into a cylindrical shape to be fitted and fixed onto the feed shaft 24. Protruding portions 29*a* extending axially are formed at positions aligned across an outer periphery of the serration member 29.

The feed roller 2 is supported onto the feed shaft 24 through a feed roller holder 28 in a state in which the feed roller 2 is removably attached to the feed roller holder 28. The feed roller 2 has a function of sending out the uppermost sheet from the sheets S, and has a rubber member provided over a certain angle (a range of a predetermined angle) on its circumference, the rubber member serving as a friction portion that is brought into contact with the sheet S. The rubber member of the feed roller 2 is formed within the range of the predetermined angle centered on the feed shaft 24. The feed roller 2 is formed to have a radius of curvature slightly larger than a radius of the feed rotatable members 30, and have an outer surface projecting outward of outer peripheral surfaces of the feed rotatable members 30. The feed rotatable members 30 are supported so as to be rotatable about the shaft of the feed roller 2, and the feed rotatable members 30 are held in press-contact with the separating pad 26 in a state in which the rubber member of the feed roller 2 is not in press-contact with the separating pad 26.

As illustrated in FIG. 2, the feed roller holder includes recessed portions 28*a* corresponding to the protruding portions 29*a*, for forming an idle zone Ar of θ0° in a rotating direction. The feed roller holder 28 is rotatable in the idle zone Ar formed by the recessed portions 28*a* and the protruding portions 29*a*. The recessed portions 28*a* are cut out so as to allow the protruding portions 29*a* to rotate and move with a clearance in a shaft hole 28*b* that is formed in a center portion of the feed roller holder 28 through which the serration member 29 passes. The idle zone Ar is a predetermined zone in which the feed roller 2 is not associated with rotation of the feed shaft 24, the idle zone Ar being provided between the feed roller 2 and the feed shaft 24.

As described above, the recessed portions 28*a* are provided on the feed roller holder side, whereas the protruding portions 29*a* are provided on the feed shaft side. The idle zone Ar is formed by the recessed portions 28*a* and the protruding portions 29*a*. Note that, the recessed portions are provided on the feed roller holder 28 as one part, and the protruding portions are provided on the feed shaft 24 as the other part. However, the way of forming the recessed portions and the protruding portions on the one and other parts may be contrary to the above-mentioned way. It is needless to say that, also in this case, the similar idle zone Ar can be realized.

The feed roller 2 starts to rotate from the feed initial position illustrated in FIG. 2, and causes a rotation-downstream-side end portion 2*a* to abut the sheets S on the rising and lowering plate 22, to thereby send out one of the sheets S with a rotation-upstream-side end portion 2*b*. After that, the feed roller 2 is returned to the above-mentioned feed initial position by the feed rotatable members 30 that are rotated in association with the sheet S conveyed to the downstream side by the conveyance rollers 3*a* and 3*b*.

As illustrated in FIG. 3, the feed roller 2 is provided on the center portion of the feed shaft 24, and the feed rotatable members 30 are provided on both axial sides of the feed roller 2, respectively. The feed rotatable members 30 are attached to the serration member 29 so as to be rotatable. Between the feed roller 2 and each of the feed rotatable members 30 on both the sides, the feed roller holder 28 is arranged. In addition, between the feed roller holder 28 and each of the feed rotatable members 30, a serration spring 31 as a compression spring is provided. The serration spring 31 constitutes a drive force transmitting member which transmits a certain amount of drive force between the feed roller holder 28 and each of the feed rotatable members 30. With this configuration, the feed rotatable members 30 can be associated with the feed roller 2 within a predetermined torque in one direction in a state in which the feed rotatable members 30 are supported onto the feed shaft 24 coaxially with the feed roller 2. As described above, with the simple and inexpensive configuration in which the serration spring 31 is provided between the feed roller holder 28 and each of the feed rotatable members 30, it is possible to realize the sheet feeding apparatus having high durability and reliability.

Note that, the feed rotatable members 30 and the conveyance rollers 3*a* and 3*b* constitute a return mechanism. The return mechanism functions to return the feed roller 2 to the feed initial position beyond the idle zone Ar after the feed roller 2 finishes feeding of each of the sheets S on the rising and lowering plate 22. In the sheet feeding apparatus, at the start of sheet feeding operation, the feed cams 21 start to rotate together with the feed shaft 24 and the feed roller 2 starts to rotate from a time when the feed shaft 24 has passed the idle zone Ar, so as to send out each of the sheets S on the rising and lowering plate 22. After that, the feed roller 2 is returned to the above-mentioned feed initial position by the above-mentioned return mechanism.

As illustrated in FIG. 1, the separating pad 26 is a friction member provided at a position opposite to the feed rotatable members 30, and has a function of separating the sheet S at the time of sheet feeding. The separating pad spring 27 as a second urging member is provided on a back surface of the separating pad 26, and has a function of urging the separating pad 26 toward the feed roller 2 and the feed rotatable members 30.

Next, with reference to FIG. 6A to FIG. 6C and FIGS. 7A and 7B, operations of the feed mechanism according to the present invention will be described step by step. Here, in order to clearly indicate a rotation position of the feed cam 21, a point on the feed cam 21 at which the feed cam 21 is in contact with the rising and lowering plate 22 at the feed initial position is designated by the reference sign P5.

Figure 6A:
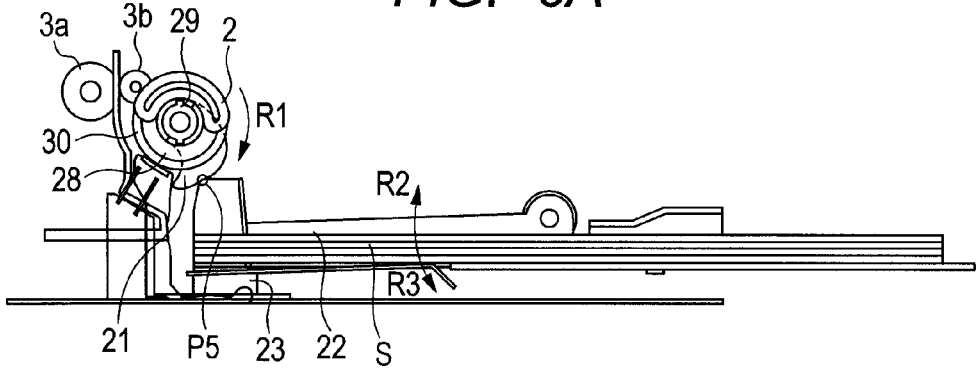
FIGS. 6A, 6B, and 6C are views each illustrating an operation of the feed portion of the image forming apparatus according to the first embodiment.

A position of the feed roller 2, the feed roller holder 28, the serration member 29, the feed cam 21, and the rising and lowering plate 22 illustrated in FIG. 6A is referred to as the feed initial position.

First, when a signal is input from an electrical substrate (not shown) to the solenoid (not shown) so that the solenoid is attracted (operated to retract), the rotational drive force in a direction indicated by the arrow R1 is transmitted from the drive train (not shown) to the feed shaft 24. Then, the serration member 29 and the feed cam 21 fixed to the feed shaft 24 start to rotate. When the feed cam 21 rotates, the rising and lowering plate 22 that receives the urging force from the feed spring 23 starts to pivot (rise) in the direction indicated by the arrow R2.

Figure 6B:
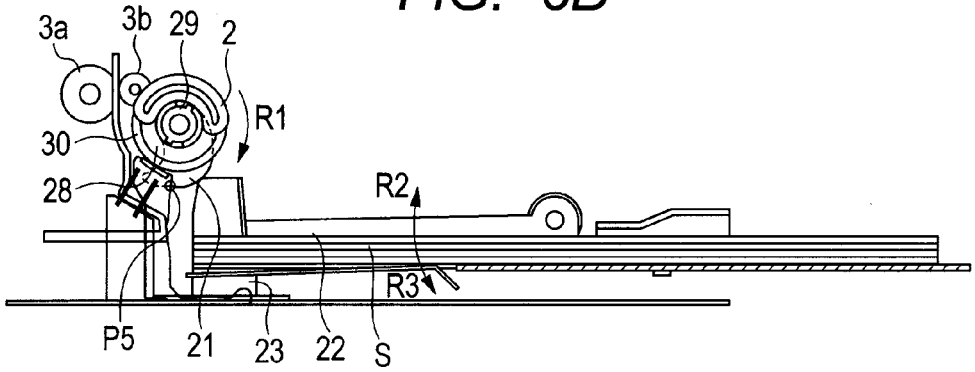

Subsequently, at the point in time when the feed shaft 24, the serration member 29, and the feed cam 21 rotate by θ0°, the idle zone Ar between the serration member 29 and the feed roller holder 28 is terminated, and then the feed roller 2 fixed to the feed roller holder 28 starts to rotate (FIG. 6B).

Figure 6C:
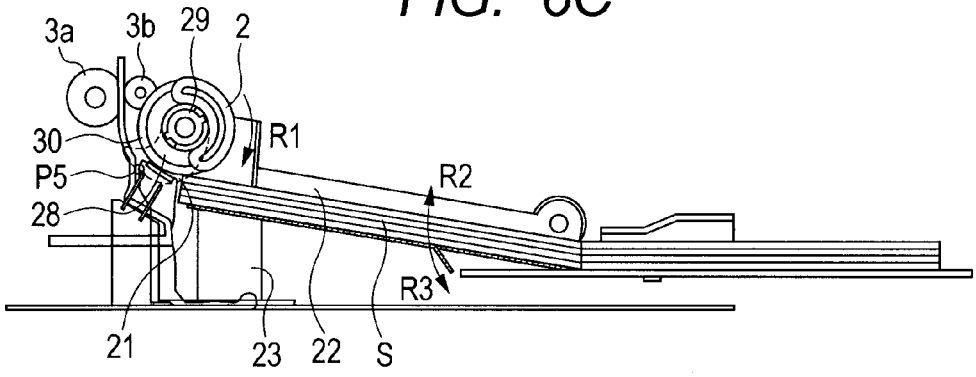

The sheets S are stacked on the rising and lowering plate 22, and the uppermost surface of the stack of the sheets S abuts the feed rotatable member 30 so that the rising and lowering plate 22 is stopped. After the rising and lowering plate 22 is stopped, the rotation-downstream-side end portion 2*a* (see FIG. 2) of the friction portion of the feed roller 2 is brought into slide-contact with the uppermost sheet S on the rising and lowering plate 22. As a result, feeding of the sheet S is started (FIG. 6C).

Figure 7A:
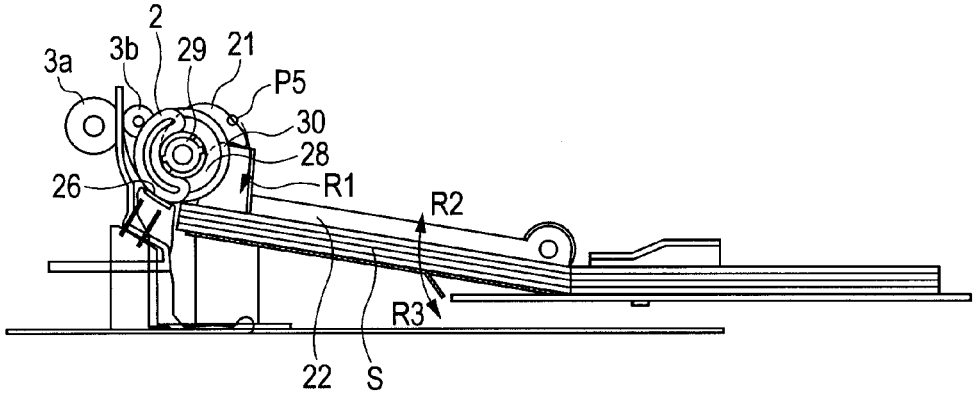
FIGS. 7A and 7B are views each illustrating the operation of the feed portion of the image forming apparatus according to the first embodiment.

After a leading end of the sheet is fed to a nip position between the conveyance rollers 3*a* and 3*b*, the feed cam 21 starts to push down the rising and lowering plate 22 in the direction indicated by the arrow R3 (FIG. 7A).

Figure 7B:
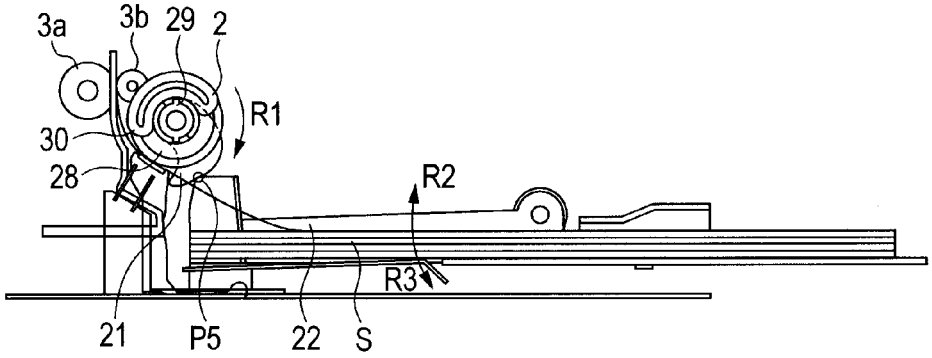

At the point in time when the rising and lowering plate 22 is returned to the feed initial position, the transmission of the rotational drive force to the feed shaft 24 is cut off, and the feed shaft 24, the serration member 29, and the feed cam 21 stop to rotate (FIG. 7B). At this time, only the feed roller 2 is situated just before the feed initial position (hereinafter, referred to as just before position) (in a state in which the recessed portions 28*a* are situated before the protruding portions 29*a*). In this state, the feed cam 21 moves the sheets S on the rising and lowering plate 22 away from the feed rotatable member 30, and hence it is possible to release a back tension acting on the sheet S to be pulled and conveyed while being nipped by the conveyance rollers 3*a* and 3*b*.

On the other hand, the sheet S conveyed to the nip position between the conveyance rollers 3*a* and 3*b* is conveyed through continuous rotation of the conveyance rollers 3*a* and 3*b*. At this time, the sheet S is nipped by the separating pad 26 and the feed rotatable member 30. By obtaining the drive force from the sheet S that is being conveyed, the feed rotatable member 30 rotates in the direction indicated by the arrow R1 in association with the movement of the sheet S. As described above, the feed rotatable member 30 transmits a certain amount of drive force to the feed roller holder 28 through the serration spring 31, and hence the feed roller holder 28 and the feed roller 2 rotate in the direction indicated by the arrow R1. Then, the upstream ends in the recessed portions 28*a* abut the protruding portions 29*a* and stop. As a result, the feed roller 2 is returned to the feed initial position (FIG. 6A).

Here, moving of the feed roller 2 from the just before position to the feed initial position relates to the fact that the feed roller 2 is required to retract from a sheet conveyance surface. That is, in a case where the feed roller 2 is situated at the just before position, there is a risk in that the rotation-upstream-side end portion 2*b* of the feed roller 2 comes close to the sheet conveyance surface and the feed roller 2 may be brought into contact with the sheet S that is being conveyed. When the feed roller 2 is brought into contact with the sheet S that is being conveyed, paper dust due to abrasion of the sheet S is generated from the contact portion. The paper dust is generated, and hence there arise problems such as a reduction in frictional force of the feed roller 2 and contamination of various rollers situated downstream of a sheet conveyance path. In order to solve the problems as well, in this embodiment, the feed roller 2 is moved from the just before position to the feed initial position, and thus a distance between the feed roller 2 and the sheet conveyance surface is sufficiently ensured.

Through repetition of the above-mentioned operations, the sheets S stacked on the feed tray 1 are separated and fed one by one in each revolution of the feed roller 2.

Figure 5:
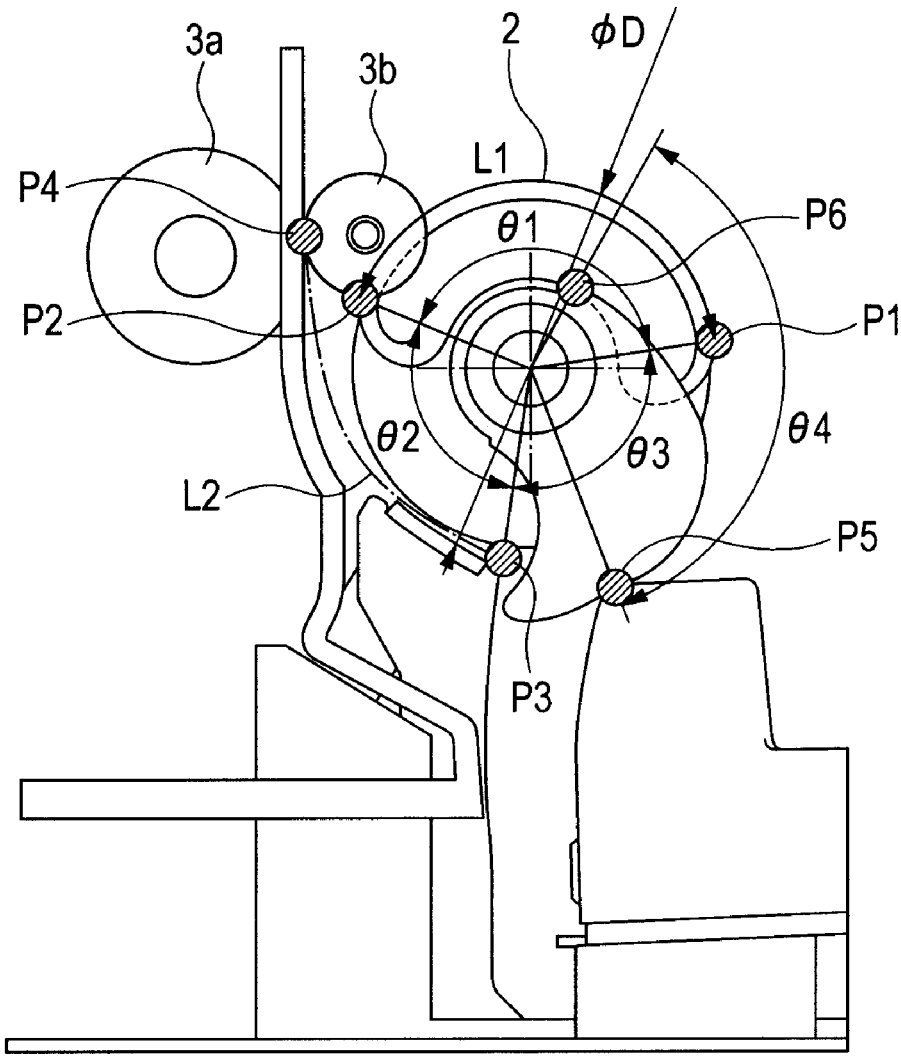
FIG. 5 is a cross-sectional view illustrating a substantial part of the feed portion of the image forming apparatus according to the first embodiment.

Next, design conditions of the feed roller 2 and the feed cam 21 for realizing the above-mentioned operations of the feed mechanism will be described with reference to FIG. 5. FIG. 5 is an enlarged view illustrating the feed roller 2 of FIG. 4 and its vicinity, and illustrating the feed initial position of the feed mechanism. For ease of understanding, here, a design condition of a conventional example having no idle zone Ar (θ0) will be first described.

First, symbols used for description of the design condition are defined. P1 represents a start point of the friction portion of the feed roller 2, and P2 represents an end point of the friction portion of the feed roller 2. P3 represents a feed point at which the uppermost sheet S of the stacked sheets S is fed by the feed roller 2, and P4 represents the nip position between the conveyance rollers 3*a* and 3*b*. Here, the start point P1 of the friction portion and the end point P2 of the friction portion are points moving in association with rotation of the feed roller 2. Further, the feed point P3 and the nip position P4 are stationary points.

P5 represents a point on the feed cam 21, at which the feed cam 21 is brought into contact with the rising and lowering plate 22 at the feed initial position, and P6 represents a point on the feed cam 21, at which the feed cam 21 is brought into contact with the rising and lowering plate 22 when the rising and lowering plate 22 reaches a top dead center. Here, the points P5 and P6 are points moving in association with rotation of the feed cam 21.

θ1 [deg] represents an angle from the start point P1 of the friction portion to the end point P2 of the friction portion of the feed roller 2, and θ2 [deg] represents an angle from the end point P2 of the friction portion to the feed point P3 of the feed roller 2. Further, θ3 [deg] represents an angle from the feed point P3 to the start point P1 of the friction portion of the feed roller 2, and θ4 [deg] represents an angle from the point P5 to the point P6 when the rising and lowering plate 22 moves from the feed initial position to reach the top dead center.

ΦD [mm] represents a diameter of the feed roller 2, and ω [deg/sec] represents rotation speed of the feed roller 2. L1 [mm] represents a length of the friction portion of the feed roller 2, and L2 [mm] represents a sheet conveyance distance from the feed point P3 to the nip position P4, which is indicated by the dashed line of FIG. 5.

With reference to the symbols described above, the design condition for realizing the operations of the feed mechanism will be described.

The feed roller 2 needs to convey the fed sheet to the nip position P4. Further, a conveyance amount of the fed sheet is equal to the length L1 if ignoring slippage between the friction portion of the feed roller 2 and the sheet. Therefore, the length L1 of the friction portion of the feed roller 2 needs to be larger than the sheet conveyance distance L2. This is expressed by the following formula (1).

$$L1>L2 \tag{1}$$

Here, the length L1 of the friction portion of the feed roller 2 is expressed by the following formula (2) from the geometric relation.

$$L1=\pi D\times(\theta 1/360) \tag{2}$$

The formula (2) is substituted into the formula (1), and the resultant formula is simplified for the angle θ1. Consequently, the following formula (3) is obtained.

$$\theta 1>360\times(L2/\pi D) \tag{3}$$

Next, in order to stabilize the sheet conveyance distance at the time of feeding, after the rising and lowering plate 22 pivots in the direction indicated by the arrow R2 of FIG. 1 and the leading end of the uppermost sheet S on a sheet stacking surface reaches the feed point P3, the start point P1 of the friction portion of the feed roller 2 needs to reach the feed point P3. That is, the angle θ4 needs to be smaller than the angle θ3. This is expressed by the following formula (4).

$$\theta 3>\theta 4 \quad (4)$$

Further, the angles θ1, θ2, and θ3 must be fall within one circumference. This is expressed by the following formula (5).

$$\theta 1+\theta 2+\theta 3=360 \quad (5)$$

The formula (4) is substituted into the formula (5), and the resultant formula is simplified for the angle θ4. Consequently, the following formula (6) is obtained.

$$\theta 4<360-(\theta 1+\theta 2) \quad (6)$$

Further, a time period τ [sec] while the rising and lowering plate 22 is moved from the feed initial position to the position of the top dead center P6 is expressed by the following formula (7).

$$\tau=\theta 4/\omega \quad (7)$$

However, in the conventional example, it has been difficult to set the angle θ4 to a sufficiently large value because of the formula (6). In other words, the lower limit value of the angle θ1 is determined from the formula (3) by determining the sheet conveyance distance L2 and the diameter ΦD based on the main body configuration. Further, the angle θ2 is inevitably determined from the geometric relation because the end point P2 of the friction portion of the feed roller 2 retracts from the sheet conveyance path by a sufficient distance. Accordingly, the upper limit value of the angle θ4 is determined from the formula (6).

On the other hand, the number of revolutions ω of the feed roller 2 is often set to the highest possible value in order to increase a throughput of the image forming apparatus. As a result, it is difficult to ensure the sufficiently long rising time period τ of the rising and lowering plate 22 because of the formula (7). Consequently, there are problems such as an increase in rising speed of the rising and lowering plate 22, and an increase in noise that is generated at the time of collision between the sheets S stacked on the rising and lowering plate 22 and the feed rotatable members 30.

However, in this embodiment, the idle zone Ar (θ0°) is provided between the feed shaft 24 and the feed roller 2, and hence it is possible to keep the feed roller 2 stopped at the feed initial position during the time period while the feed shaft 24 rotates (idles) in the idle zone Ar (θ0°). That is, in the conventional example, the upper limit value of the angle θ4 is determined from the condition of the formula (6). However, using the configuration in this embodiment enables relaxation of the design condition of the angle θ4 as expressed by the following formula (8).

$$\theta 4<(360+\theta 0)-(\theta 1+\theta 2) \quad (8)$$

Further, when a stopping time period of the feed roller 2 is represented as τ0 [sec], the following formula (9) is obtained.

$$\tau 0=\theta 0/\omega \quad (9)$$

In a case where each of the diameter ΦD of the feed roller 2 and the rotation speed co of the feed roller 2 is set to a certain value, it is possible to extend a time period while the rising and lowering plate 22 rises from the feed initial position to a feed position by τ0 [sec] as compared to the conventional example.

Figure 8:
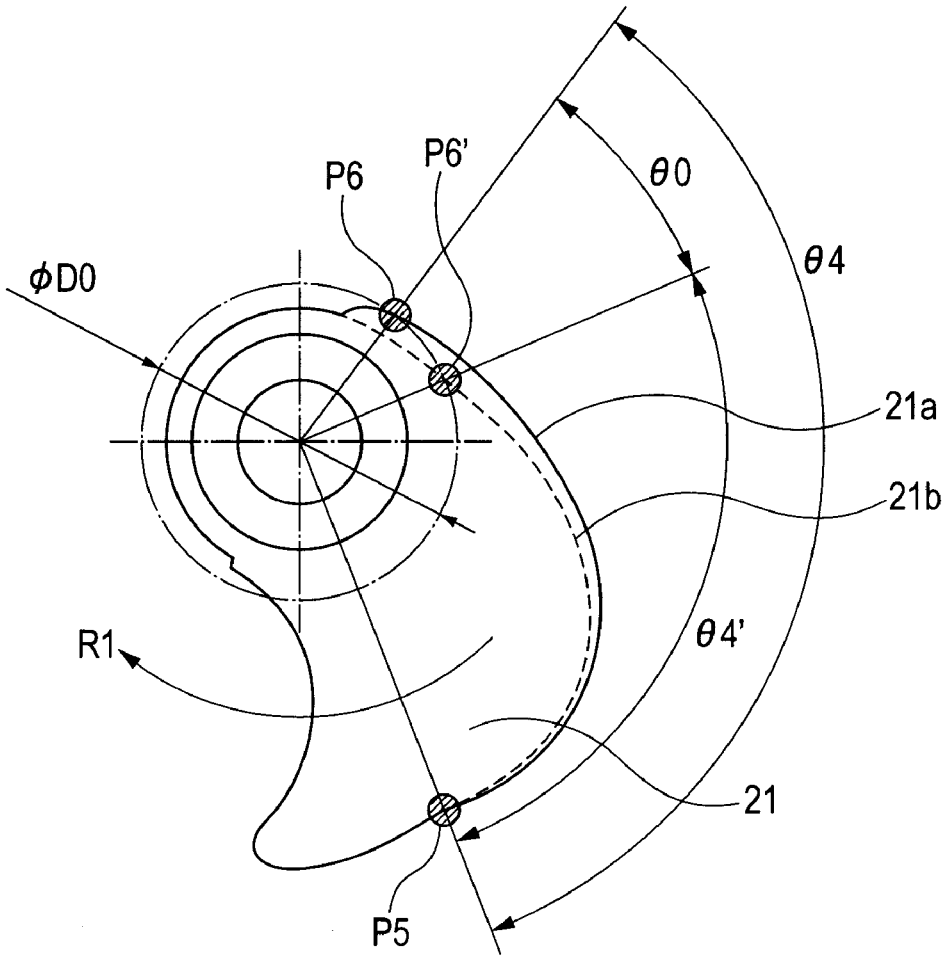
FIG. 8 is an explanatory diagram illustrating a substantial part of the feed portion of the image forming apparatus according to the first embodiment.

Owing to the relaxation of the design condition of the above-mentioned formula (8), in this embodiment, by changing a cam curved surface of the feed cam 21 as illustrated in FIG. 8, the rising time period of the rising and lowering plate 22 is extended by τ0.

Here, ΦD0 represents a diameter that has no contact point with the rising and lowering plate 22 in a case where a cam curve of the feed cam 21 is situated within the diameter ΦD0. That is, in a case where the feed cam 21 rotates in the direction indicated by the arrow R1, an intersection between the diameter ΦD0 and the cam curve corresponds to the top dead center of the rising and lowering plate 22. A cam curve 21*b* (broken line) indicates a conventional cam curve. Further, a cam curve 21*a* (solid line) indicates the cam curve in this embodiment. Here, an intersection between the cam curve 21*b* (conventional example) and the diameter ΦD0 and an intersection between the cam curve 21*a* (this embodiment) and the diameter ΦD0 are represented as P6' (conventional example) and P6 (this embodiment), respectively.

In the conventional example, between the point P5 and the point P6', that is, within a range of an angle θ4', the rising and lowering plate 22 rises. In contrast, in this embodiment, the idle zone Ar (θ0°) is provided between the feed shaft 24 and the feed roller 2, and hence the point P6' can be shifted to the point P6, with the result that the rising and lowering plate 22 can rise within the range of the angle θ4. Thus, it is possible to realize the above-mentioned extension of the rising time period of the rising and lowering plate 22.

As described above, in this embodiment, at the start of sheet feeding operation, the feed cams 21 start to rotate and the feed roller 2 starts to rotate from a time when the feed cams 21 pass the idle zone Ar, so as to send out each of the sheets S on the rising and lowering plate 22. After that, the feed roller 2 is returned to the feed initial position by the return mechanism including the feed rotatable members 30 and the conveyance rollers 3*a* and 3*b*. Thus, the cam curve of the feed cam 21 can be changed from the cam curve 21*b* (conventional example) to the cam curve 21*a* (this embodiment) as illustrated in FIG. 8. Therefore, the point P6' of FIG. 8 is shifted to the point P6 so that the rising and lowering plate 22 can rise within the range of the angle θ4 extended from the conventional range of the angle θ4', and that the rising time period of the rising and lowering plate 22 can be extended as compared to the conventional example.

According to this embodiment, by changing the cam curve as described above, the rising speed of the rising and lowering plate 22 is reduced as compared to the conventional configuration, and generation of noise at the time of collision between the sheets S on the rising and lowering plate 22 and the feed rotatable members 30 is reduced. Consequently, it is possible to provide the image forming apparatus having lower noise level. Further, by reducing the rising speed of the rising and lowering plate 22, it is possible to feed the sheet S stably without disturbing the alignment property of the sheets S stacked on the rising and lowering plate 22. As a result, it is possible to suppress occurrence of image failure, jamming, and the like due to skew of the sheet, and to provide the image forming apparatus having higher reliability.

Modified Example 1

For example, the diameter ΦD of the feed roller 2 is a fixed value in the first embodiment, but the present invention is similarly and suitably applicable also to a case of reducing the diameter ΦD.

That is, when the diameter ΦD is reduced in the conventional example, the angle θ1 is increased because of the formula (3). Then, the angle θ4 is set to a small value because of the formula (6). As a result, the rising time period τ of the rising and lowering plate 22 is set to a small value because of the formula (7), and the increase in a rising speed of the rising and lowering plate 22 degrades the noise level. However, by using the configuration described in the first embodiment, it is possible to extend the rising time period of the rising and lowering plate 22 by τ0 [sec] in a similar way, and to provide the image forming apparatus having a small size and low noise level.

Modified Example 2

Further, the rotation speed ω [deg/sec] of the feed roller 2 is a fixed value in the first embodiment, but the present invention is similarly and effectively applicable also to a case of increasing the rotation speed of the feed roller 2.

That is, when the rotation speed ω is increased in the conventional example, the rising time period τ of the rising and lowering plate 22 is set to a small value because of the formula (7), and the increase in the rising speed of the rising and lowering plate 22 increases noise. However, by using the configuration described in the first embodiment, it is possible to extend the rising time period of the rising and lowering plate 22 by τ0 [sec] in a similar way, and to provide the image forming apparatus having high speed and low noise level.

Second Embodiment

Figure 9:
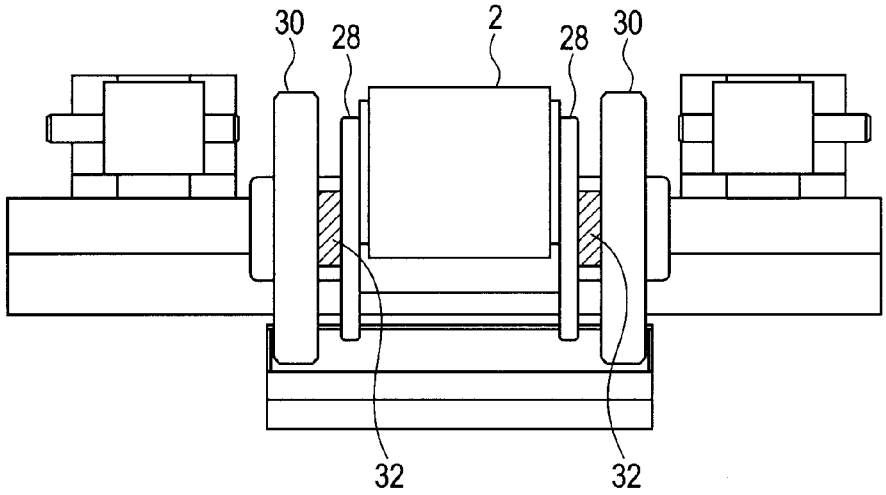
FIG. 9 is an explanatory diagram illustrating a substantial part of a feed portion of the image forming apparatus according to a second embodiment.

Further, in the first embodiment and Modified Examples 1 and 2, the serration spring 31 formed of a compression spring is used as a member having a function of transmitting a certain amount of drive force between the feed roller holder 28 and the feed rotatable member 30. Instead of this configuration, as illustrated by hatched portions of FIG. 9, a configuration in which friction members 32 made of a rubber material are provided is similarly suitable. As described above, with the simple and inexpensive configuration in which each of the friction members 32 is provided between the feed roller holder 28 and the feed rotatable member 30, it is possible to realize the sheet feeding apparatus having high durability and reliability.

Figure 10:
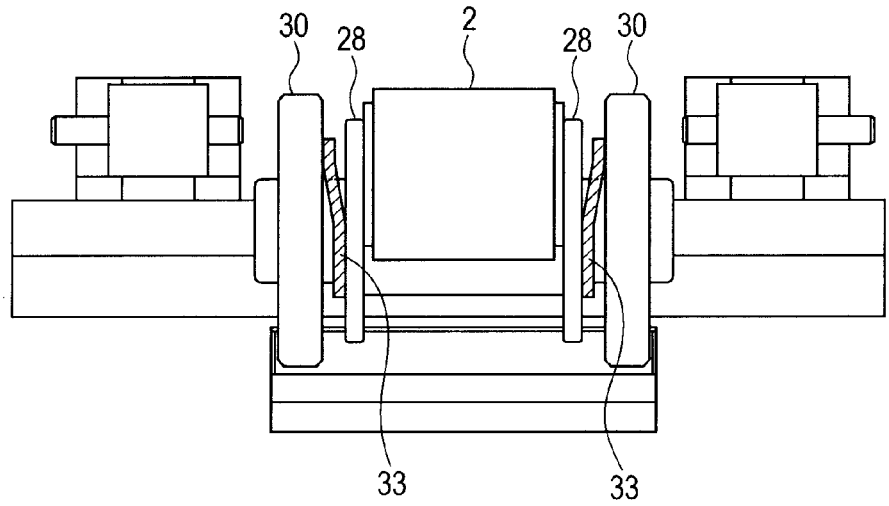
FIG. 10 is an explanatory diagram illustrating a substantial part of the feed portion of the image forming apparatus according to the second embodiment.

Further, instead of the serration springs 31, as illustrated by hatched portions of FIG. 10, a configuration in which plate springs 33 are provided is similarly suitable. Further, in the first embodiment and Modified Examples 1 and 2, the feed rotatable members 30 are provided on both the axial sides of the feed roller 2, respectively, but the present invention is not limited thereto. A configuration in which the feed rotatable member 30 is provided only on one side thereof is similarly suitable.

Third Embodiment

As described in the first embodiment, the idle zone Ar is provided between the feed roller holder 28 and the serration member 29, and hence the feed roller 2 can rotate freely about the feed shaft 24 by an amount of the idle zone Ar. Thus, when the feed roller 2 is attached and detached from the feed roller holder 28, the feed roller 2 rotates by the amount of the idle zone Ar, which may deteriorate a replaceability of the feed roller 2.

A third embodiment is made for improving the replaceability of the feed roller 2, and will be described with reference to FIG. 11 to FIGS. 14A and 14B. In the configuration of this embodiment, the same components described in the first embodiment are denoted by the same reference symbols. Further, description of the same components and functions as those of the first embodiment will be omitted, and only features of this embodiment will be described.

Figure 11:
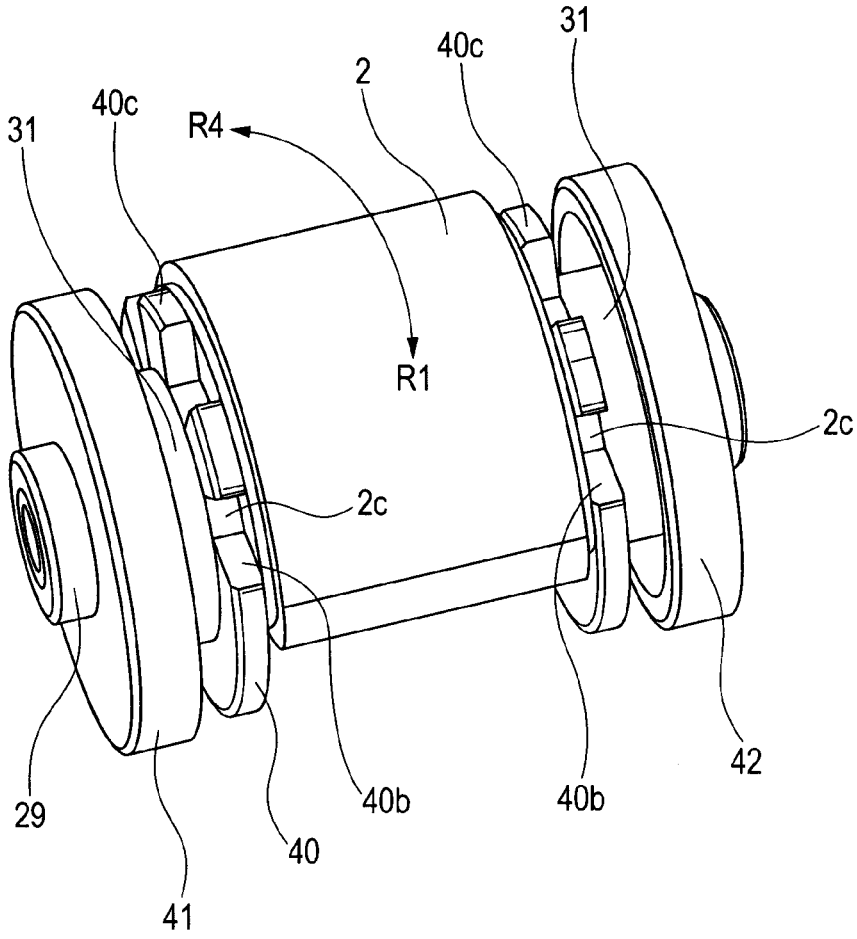
FIG. 11 is a perspective view illustrating a feed roller portion of the image forming apparatus according to a third embodiment.

FIG. 11 is a perspective view illustrating a feed roller portion of this embodiment. Similarly to the first embodiment, the feed roller portion includes the feed roller 2, the serration member 29, the serration springs 31 as compression springs, a feed roller holder 40, and feed rotatable members 41 and 42.

Next, a configuration of attaching the feed roller 2 to the feed roller holder 40 and a method of attaching and detaching the feed roller 2 from the feed roller holder 40 will be described with reference to FIGS. 12A to 12C.

Figure 12A:
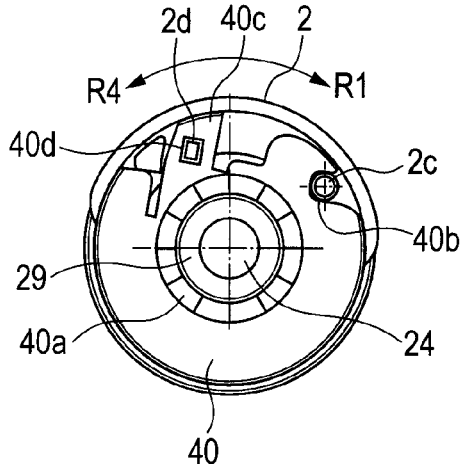
FIGS. 12A, 12B, and 12C are side views illustrating a method of attaching and detaching a feed roller of the image forming apparatus according to the third embodiment.

As illustrated in FIG. 12A, the feed roller 2 is attached to the feed roller holder 40 in such a manner that a boss 2*c* of the feed roller 2 and a recessed portion 40*b* of the feed roller holder 40 are fitted to each other and a rib 2*d* of the feed roller 2 and a hole 40*d* provided in a hook 40*c* of the feed roller holder 40 are fitted to each other. As illustrated in FIG. 11, the boss 2*c* and the rib 2*d* of the feed roller are provided on each side of the feed roller 2, and the recessed portion 40*b*, the hook 40*c*, and the hole 40*d* of the feed roller holder 40 are provided on each side of the feed roller holder 40.

Figure 12B:
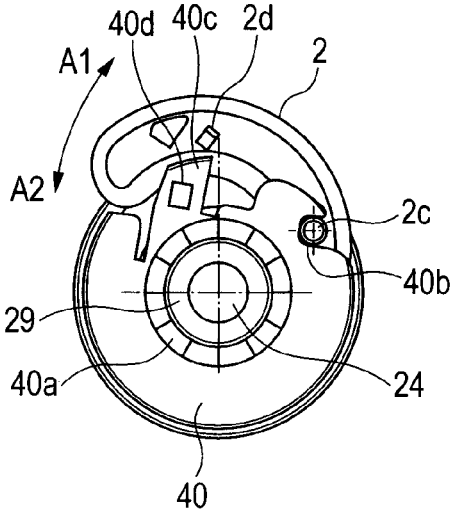
Figure 12C:
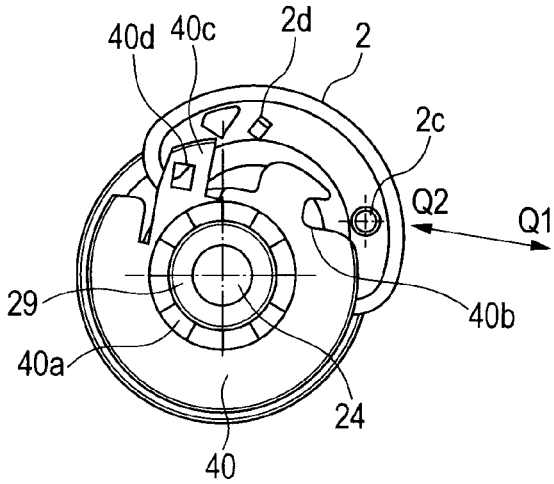

As illustrated in FIG. 12B, in a case of detaching the feed roller 2 from the feed roller holder 40, the hooks 40*c* of the feed roller holder 40 are tilted toward the feed rotatable members 41 and 42, and the feed roller 2 is rotated about the bosses 2*c* in a direction indicated by the arrow A1, with the result that the ribs 2*d* are detached from the holes 40*d*. Then, as illustrated in FIG. 12C, the feed roller 2 is moved in a direction indicated by the arrow Q1, and the bosses 2*c* are detached from the recessed portions 40*b*. In this manner, the feed roller 2 can be detached from the feed roller holder 40. On the other hand, in a case of attaching the feed roller 2 to the feed roller holder 40, as illustrated in FIG. 12C, the feed roller 2 is moved in a direction indicated by the arrow Q2, and the bosses 2*c* are fitted into the recessed portions 40*b*. Then, as illustrated in FIG. 12B, the feed roller 2 is rotated about the bosses 2*c* in a direction indicated by the arrow A2, and the ribs 2*d* are fitted into the holes 40*d*. In this manner, the feed roller 2 can be attached to the feed roller holder 40.

As described above, when attaching the feed roller 2 to the feed roller holder 40, the feed roller holder 40 receives a rotational force in a direction indicated by the arrow R4 (see FIG. 11 and FIGS. 12A to 12C) from the feed roller 2.

In other words, at the time of attachment and detachment of the feed roller 2, a rotational phase between the feed roller 2 and the feed roller holder 40 is determined. When the feed roller holder 40 rotates unexpectedly, the feed roller 2 may be difficult to attach.

Figure 13A:
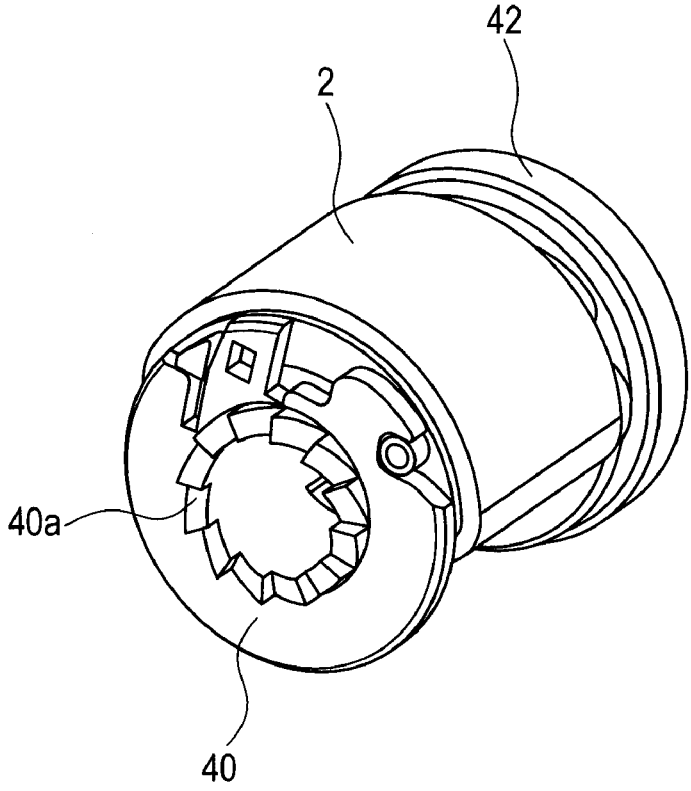
FIG. 13A is a perspective view illustrating a feed roller holder of the image forming apparatus according to the third embodiment.
Figure 13B:
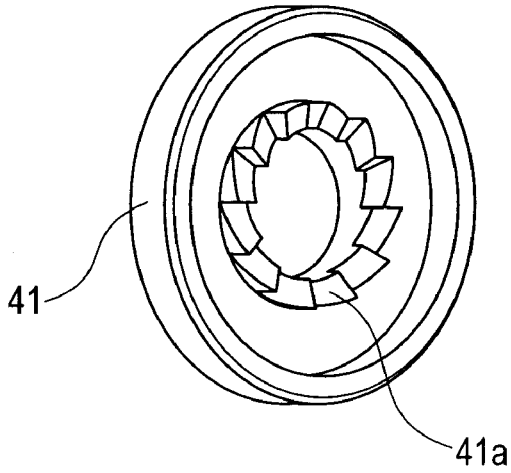
FIG. 13B is a perspective view illustrating a feed rotatable member of the image forming apparatus according to the third embodiment.

FIGS. 13A and 13B are perspective views illustrating the feed roller holder 40 and the feed rotatable member 41, respectively. As illustrated in FIG. 13A, on a left side surface of the feed roller holder 40, there are provided ratchet teeth 40*a* formed of multiple triangular teeth arranged in an annular fashion. Similarly, as illustrated in FIG. 13B, on a right side surface of the feed rotatable member 41, there are provided ratchet teeth 41*a* formed of multiple triangular teeth arranged in an annular fashion. The ratchet teeth 40*a* of the feed roller holder 40 and the ratchet teeth 41*a* of the feed rotatable member 41 are shaped so as to be meshed with each other.

Figure 14A:
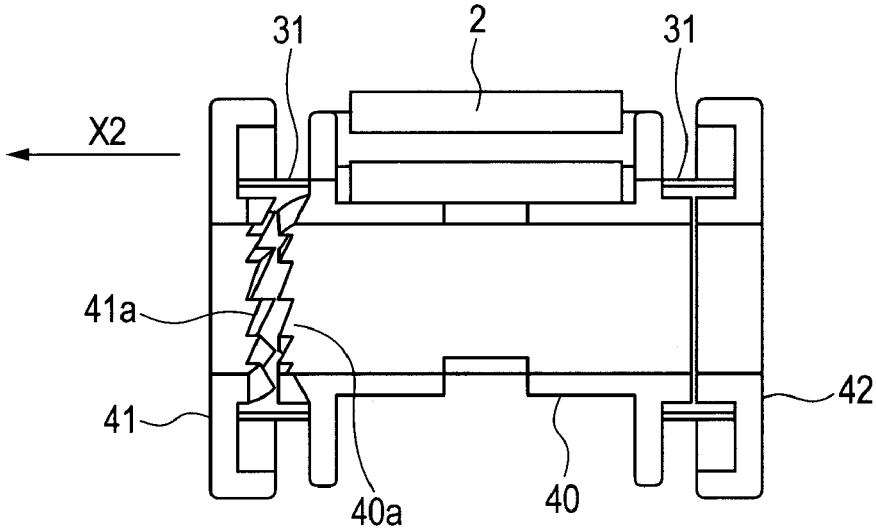
FIG. 14A is a cross-sectional view illustrating the feed roller portion of the image forming apparatus according to the third embodiment at the time of feeding operation.

Next, with reference to FIGS. 14A and 14B, meshing between the ratchet teeth 40*a* of the feed roller holder 40 and the ratchet teeth 41*a* of the feed rotatable member 41 will be described. FIG. 14A is a cross-sectional view illustrating the feed roller portion at the time of feeding operation, and FIG. 14B is a cross-sectional view illustrating the feed roller portion in a case where the feed rotatable member 41 is moved.

Figure 14B:
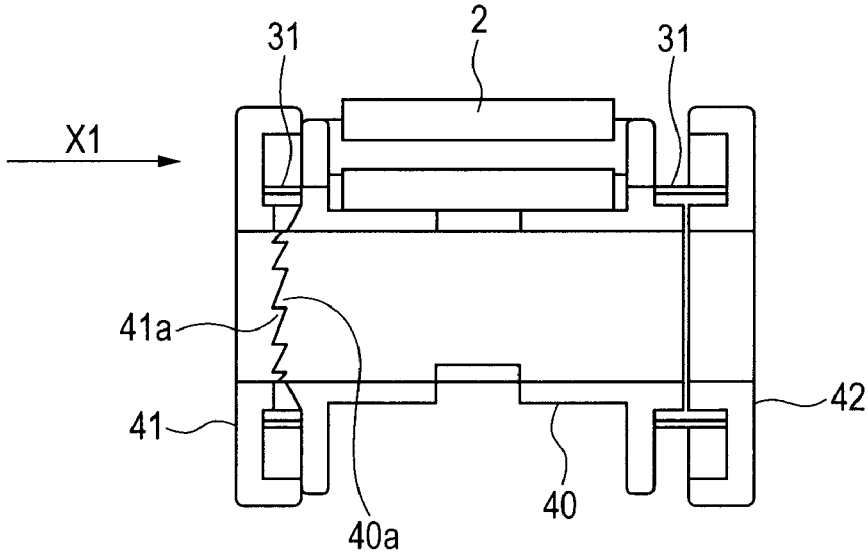
FIG. 14B is a cross-sectional view illustrating the feed roller portion in a case where the feed rotatable member of the image forming apparatus according to the third embodiment is moved.

As illustrated in FIG. 14B, when the feed rotatable member 41 is moved in a direction indicated by the arrow X1, the ratchet teeth 40*a* of the feed roller holder 40 and the ratchet teeth 41*a* of the feed rotatable member 41 are meshed with each other. When the ratchet teeth 40*a* and the ratchet teeth 41*a* are meshed with each other and the feed roller holder 40 and the feed rotatable member 41 are coupled to each other, the feed roller holder 40 is inhibited from rotating in the direction indicated by the arrow R4 illustrated in FIG. 11.

When attaching the feed roller 2 to the feed roller holder 40, the feed roller holder 40 receives the rotational force in the direction indicated by the arrow R4 from the feed roller 2. However, the feed roller holder 40 is inhibited from rotating in the direction indicated by the arrow R4, and hence the feed roller 2 is easily attached to the feed roller holder 40.

Further, as illustrated in FIG. 14A, at the time of feeding operation, the feed rotatable member 41 is urged by the serration spring 31 in a direction indicated by the arrow X2, and hence the ratchet teeth 40*a* and the ratchet teeth 41*a* are not meshed with each other. Therefore, the feed rotatable member 41 does not hinder the feeding operation.

As described above, in this embodiment, there is provided an engagement portion for temporarily engaging the feed roller 2 and the feed shaft 24 with each other. The engagement portion is configured to inhibit the feed roller 2 from rotating from the feed initial position. In other words, in this embodiment, the feed roller holder 40 for supporting the feed roller 2 onto the feed shaft 24, and the feed rotatable member 41 which is supported on the feed shaft 24 coaxially with the feed roller 2 and can be associated with the rotation of the feed roller 2 within a predetermined torque in one direction are provided. The engagement portion includes the ratchet teeth (engagement teeth) 40*a* on the feed roller holder 40 and the ratchet teeth (engagement teeth) 41*a* on the feed rotatable member 41. Further, the engagement portion engages the ratchet teeth 40*a* and 41*a* with each other to couple the feed roller holder 40 and the feed rotatable member 41 to each other, to thereby inhibit the feed roller 2 from rotating from the feed initial position.

Therefore, in a case where a user replaces the feed roller 2, when the feed rotatable member 41 is moved in the direction indicated by the arrow X1, the ratchet teeth 40*a* of the feed roller holder 40 and the ratchet teeth 41*a* of the feed rotatable member 41 are meshed with each other. This inhibits the feed roller holder 40 from rotating in the direction indicated by the arrow R4, and hence it is possible to improve the replaceability of the feed roller 2.

Further, in this embodiment, the ratchet teeth are provided only on the left side surface of the feed roller holder 40 and the feed rotatable member 41. However, the present invention is not limited thereto. A configuration in which the ratchet teeth are provided only on the right side surface of the feed roller holder 40 and the feed rotatable member 42, or on both side surfaces of the feed roller holder 40 and both the feed rotatable members 41 and 42 is similarly suitable. In addition, in this embodiment, the engagement portion includes the ratchet teeth, but the present invention is not limited thereto. A recessed portion and a protruding portion to be engaged with each other may be provided on the feed roller holder 40 and the feed rotatable members 41 and 42.

Fourth Embodiment

Similarly to the third embodiment, a fourth embodiment is also made for improving the replaceability of the feed roller 2, and will be described with reference to FIGS. 15A and 15B and FIGS. 16A and 16B. In the configuration of this embodiment, the same components described in the first embodiment are denoted by the same reference symbols. Further, description of the same components and functions as those of the first embodiment will be omitted, and only features of this embodiment will be described.

Figure 15A:
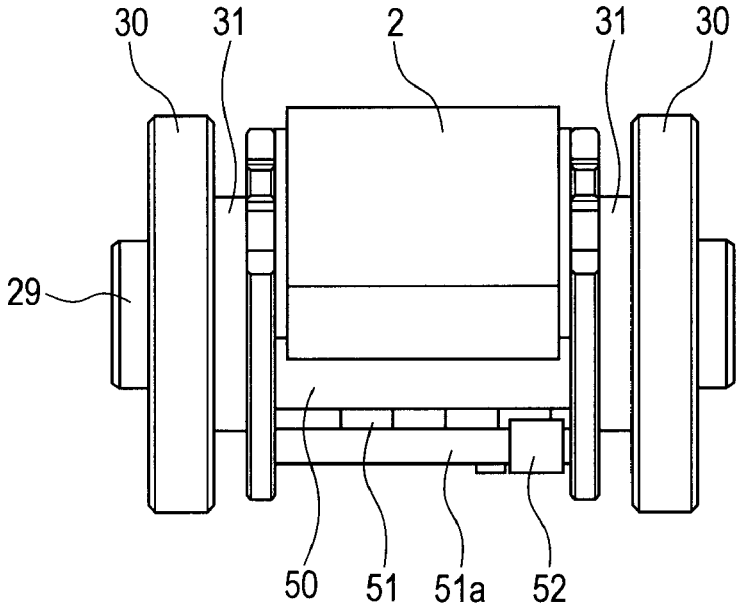
FIGS. 15A and 15B are a front view and a cross-sectional view illustrating the feed roller portion in a case where a feed roller of the image forming apparatus according to a fourth embodiment is attached.
Figure 15B:
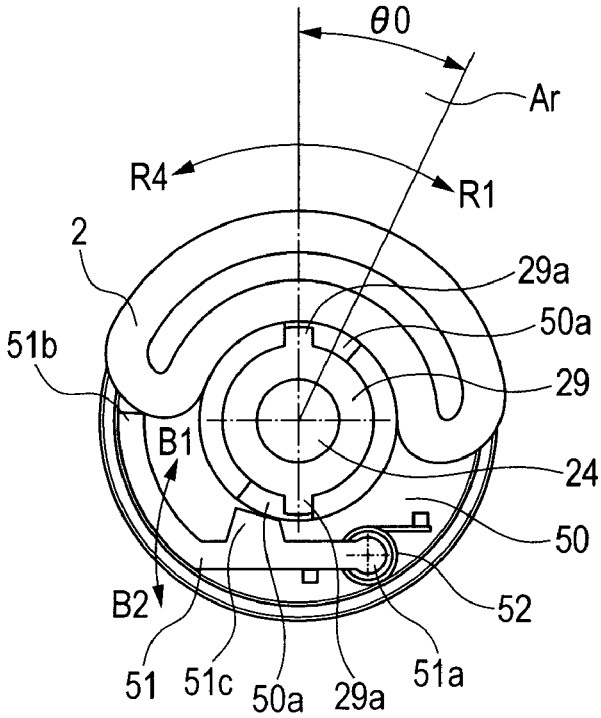
Figure 16A:
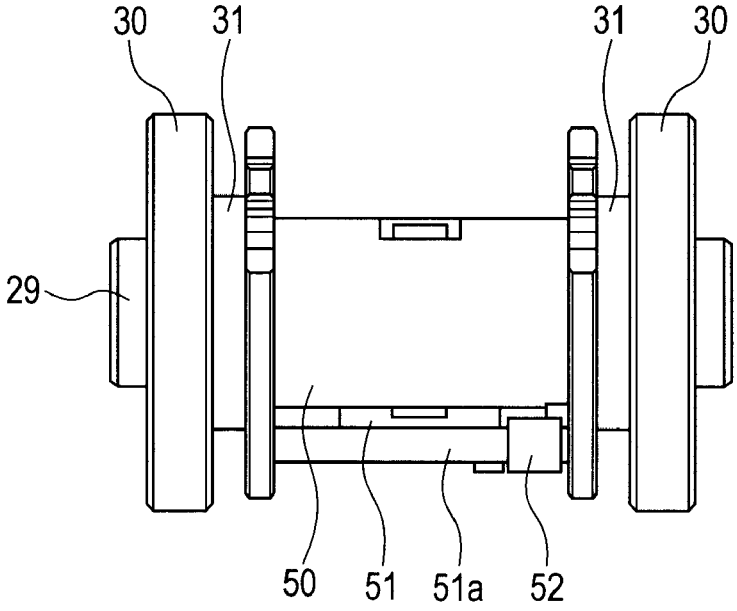
FIGS. 16A and 16B are a front view and a cross-sectional view illustrating the feed roller portion in a case where the feed roller of the image forming apparatus according to the fourth embodiment is detached.
Figure 16B:
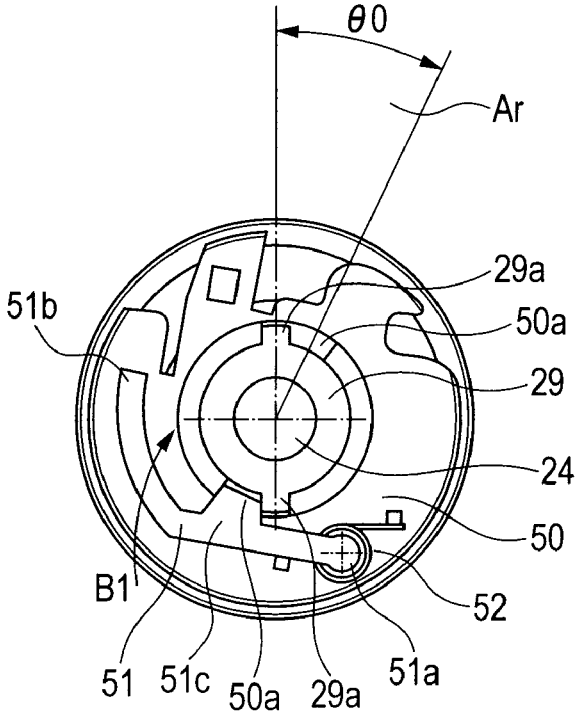

FIGS. 15A and 15B are views illustrating a feed roller portion in a case where the feed roller 2 is attached. FIG. 15A is a front view of the feed roller portion, and FIG. 15B is a cross-sectional view thereof. FIGS. 16A and 16B are views illustrating the feed roller portion in a case where the feed roller 2 is detached. FIG. 16A is a front view of the feed roller portion, and FIG. 16B is a cross-sectional view thereof.

As illustrated in FIGS. 15A and 15B and FIGS. 16A and 16B, a lever 51 is arranged on a lower portion of a feed roller holder 50, and a shaft 51*a* of the lever 51 is held by the feed roller holder 50 so as to be rotatable. A torsion coil spring 52 is fixed to the shaft 51*a* of the lever 51, and urges the lever 51 in a direction indicated by the arrow B1.

Next, an operation and action of the lever 51 will be described. As illustrated in FIGS. 15A and 15B, in the case where the feed roller 2 is attached, an end portion 51*b* of the lever 51 is brought into contact with the feed roller 2, and the lever 51 pivots in a direction indicated by the arrow B2. With this configuration, an engagement protruding portion 51*c* provided on a middle portion of the lever 51 is not brought into contact with the serration member 29, and hence the engagement protruding portion 51*c* is not engaged with recessed portions 50*a* of the feed roller holder 50. Thus, the feed roller 2 can rotate freely in the directions indicated by the arrows R1 and R4.

As illustrated in FIGS. 16A and 16B, in a state in which the feed roller 2 is detached, the lever 51 pivots in the direction indicated by the arrow B1 owing to the urging force of the torsion coil spring 52. Then, the engagement protruding portion 51*c* of the lever 51 is fitted into the idle zone Ar between the protruding portion 29*a* of the serration member 29 and the recessed portion 50*a* of the feed roller holder 50. Thus, the feed roller holder 50 is inhibited from rotating in the idle zone Ar between the serration member 29 and the feed roller holder 50.

The configuration of attaching the feed roller 2 to the feed roller holder 50 and the method of attaching and detaching the feed roller 2 from the feed roller holder 50 according to this embodiment are the same as those of the third embodiment.

As described above, in this embodiment, there is provided an engagement portion for temporarily engaging the feed roller 2 and the feed shaft 24 with each other. The engagement portion is configured to inhibit the feed roller 2 from rotating from the feed initial position. In other words, in this embodiment, the feed roller holder 50 for supporting the feed roller 2 on the feed shaft 24 is provided. Further, the engagement portion includes the lever (lever member) 51 which is fitted to the feed roller holder 50 and is movable depending on the presence and absence of the feed roller 2, and the torsion coil spring (lever urging member) 52 for urging the lever 51 toward the feed roller. In the case where the feed roller 2 is detached, the engagement portion engages the engagement protruding portion 51*c* of the lever 51 with the feed shaft 24 to couple the feed roller holder 50 and the feed shaft 24 to each other, to thereby inhibit the feed roller 2 from rotating from the feed initial position.

Therefore, when a user attaches the feed roller 2 to the feed roller holder 50, the action of the lever 51 inhibits the feed roller holder 50 from rotating, and hence it is easy to attach the feed roller 2 to the feed roller holder 50.

In addition, in this embodiment, the engagement protruding portion 51*c* of the lever 51 is engaged with (fitted to) the protruding portion 29*a* of the serration member 29, but the present invention is not limited thereto. The engagement protruding portion 51*c* of the lever 51 may be fitted to or interfere with another portion of the serration member 29.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-146195 filed Jun. 28, 2010, and No. 2010-259020 filed Nov. 19, 2010 which are hereby incorporated by reference herein in their entirety.

What is claimed is:

1. A sheet feeding apparatus, comprising:

a sheet stacking portion which rises and lowers while sheets are stacked on the sheet stacking portion;

a feed roller which is attached to a feed shaft and rotates from a feed initial position in association with rotation in one direction of the feed shaft to send out each of the sheets stacked on the sheet stacking portion;

an urging member which urges the sheet stacking portion to press the stacked sheets toward the feed roller;

a cam member which rotates in association with the rotation of the feed shaft to raise and lower the sheet stacking portion;

a predetermined idle zone provided between the feed roller and the feed shaft, for preventing the feed roller from being associated with the rotation of the feed shaft; and a return mechanism which returns the feed roller to the feed initial position after the feed roller finishes feeding of each of the sheets on the sheet stacking portion, wherein at a start of sheet feeding operation, the cam member starts to rotate in association with the rotation of the feed shaft and the feed roller starts to rotate from a time when the feed shaft has passed the predetermined idle zone, so as to send out each of the sheets on the sheet stacking portion, and thereafter the feed roller is returned to the feed initial position by the return mechanism.

2. A sheet feeding apparatus according to claim 1, wherein the feed roller is supported on the feed shaft through a feed roller holder, and wherein the predetermined idle zone is formed by a recessed portion and a protruding portion, the recessed portion being provided on one of the feed roller holder and the feed shaft, and the protruding portion being provided on the other of the feed roller holder and the feed shaft.

3. A sheet feeding apparatus according to claim 1, wherein the return mechanism comprises:

a feed rotatable member which is supported on the feed shaft coaxially with the feed roller and is associated with the feed roller within a predetermined torque in the one direction; and a conveyance roller which conveys each of the sheets sent out from the sheet stacking portion to a downstream side, and wherein the feed roller comprises a roller formed over a range of a predetermined angle centered on the feed shaft, and after the feed roller starts to rotate from the feed initial position and causes a rotation-downstream-side end portion of the feed roller to abut the sheets on the sheet stacking portion to send out each of the sheets with a rotation-upstream-side end portion of the feed roller, the feed roller is returned to the feed initial position by the feed rotatable member which is rotated in association with each of the sheets conveyed to the downstream side by the conveyance roller.

4. A sheet feeding apparatus according to claim 1, further comprising an engagement portion which temporarily engages the feed roller and the feed shaft with each other, wherein the engagement portion inhibits the feed roller from rotating from the feed initial position.

5. A sheet feeding apparatus according to claim 4, further comprising:

a feed roller holder which supports the feed roller on the feed shaft; and a feed rotatable member which is supported on the feed shaft coaxially with the feed roller and is associated with the feed roller within a predetermined torque in the one direction, wherein the engagement portion comprises engagement teeth on the feed roller holder and engagement teeth on the feed rotatable member, and the engagement portion engages the engagement teeth on the feed roller holder and the engagement teeth on the feed rotatable member with each other to couple the feed roller holder and the feed rotatable member to each other, to thereby inhibit the feed roller from rotating from the feed initial position.

6. A sheet feeding apparatus according to claim 4, further comprising a feed roller holder which supports the feed roller on the feed shaft, wherein the engagement portion comprises:

a lever member which is attached to the feed roller holder and is movable depending on presence and absence of the feed roller; and a lever urging member which urges the lever member toward the feed roller, and wherein in a case where the feed roller is detached, the engagement portion engages an engagement protruding portion of the lever member with the feed shaft to couple the feed roller holder and the feed shaft to each other, to thereby inhibit the feed roller from rotating from the feed initial position.

7. An image forming apparatus, comprising:

a sheet feeding apparatus which feeds a sheet;

an image forming portion which forms an image on the sheet fed by the sheet feeding apparatus;

a sheet stacking portion which rises and lowers while sheets are stacked on the sheet stacking portion;

a feed roller which is attached to a feed shaft and rotates from a feed initial position in association with rotation in one direction of the feed shaft to send out each of the sheets stacked on the sheet stacking portion;

an urging member which urges the sheet stacking portion to press the stacked sheets toward the feed roller;

a cam member which rotates in association with the rotation of the feed shaft to raise and lower the sheet stacking portion;

a predetermined idle zone provided between the feed roller and the feed shaft, for preventing the feed roller from being associated with the rotation of the feed shaft; and a return mechanism which returns the feed roller to the feed initial position after the feed roller finishes feeding of each of the sheets on the sheet stacking portion, wherein at a start of sheet feeding operation, the cam member starts to rotate in association with the rotation of the feed shaft and feed roller starts to rotate from a time when the feed shaft has passed the predetermined idle zone, so as to send out each of the sheets on the sheet stacking portion, and thereafter the feed roller is returned to the feed initial position by the return mechanism.

8. An image forming apparatus according to claim 7, wherein the feed roller is supported on the feed shaft through a feed roller holder, and wherein the predetermined idle zone is formed by a recessed portion and a protruding portion, the recessed portion being provided on one of the feed roller holder and the feed shaft, the protruding portion being provided on the other of the feed roller holder and the feed shaft.

9. An image forming apparatus according to claim 7, wherein the return mechanism comprises:

a feed rotatable member which is supported on the feed shaft coaxially with the feed roller and is associated with the feed roller within a predetermined torque in the one direction; and a conveyance roller which conveys each of the sheets sent out from the sheet stacking portion to a downstream side, and wherein the feed roller comprises a roller formed over a range of a predetermined angle centered on the feed shaft, and after the feed roller starts to rotate from the feed initial position and causes a rotation-downstream-side end portion of the feed roller to abut the sheets on the sheet stacking portion to send out each of the sheets with a rotation-upstream-side end portion of the feed roller, the feed roller is returned to the feed initial position by the feed rotatable member which is rotated in association with each of the sheets conveyed to the downstream side by the conveyance roller.

10. An image forming apparatus according to claim 7, further comprising an engagement portion which temporarily engages the feed roller and the feed shaft with each other, wherein the engagement portion inhibits the feed roller from rotating from the feed initial position.

11. An image forming apparatus according to claim 10, further comprising:

a feed roller holder which supports the feed roller on the feed shaft; and a feed rotatable member which is supported on the feed shaft coaxially with the feed roller and is associated with the feed roller within a predetermined torque in the one direction, wherein the engagement portion comprises engagement teeth on the feed roller holder and engagement teeth on the feed rotatable member, and the engagement portion engages the engagement teeth on the feed roller holder and the engagement teeth on the feed rotatable member with each other to couple the feed roller holder and the feed rotatable member to each other, to thereby inhibit the feed roller from rotating from the feed initial position.

12. An image forming apparatus according to claim 10, further comprising a feed roller holder which supports the feed roller on the feed shaft, wherein the engagement portion comprises:

a lever member which is attached to the feed roller holder and is movable depending on presence and absence of the feed roller; and a lever urging member which urges the lever member toward the feed roller, and wherein in a case where the feed roller is detached, the engagement portion engages an engagement protruding portion of the lever member with the feed shaft to couple the feed roller holder and the feed shaft to each other, to thereby inhibit the feed roller from rotating from the feed initial position.

* * * * *